US007901026B2

(12) United States Patent
Albertalli et al.

(10) Patent No.: US 7,901,026 B2
(45) Date of Patent: Mar. 8, 2011

(54) DROP ANALYSIS SYSTEM

(75) Inventors: David Albertalli, Santa Clara, CA (US); Robert G. Boehm, Jr., Livermore, CA (US); Oleg N. Gratchev, San Jose, CA (US); James N Middleton, Brentwood, CA (US); Perry West, Los Gatos, CA (US)

(73) Assignee: ULVAC, Inc., Kanagawa (JP)

( * ) Notice: Subject to any disclaimer, the term of this patent is extended or adjusted under 35 U.S.C. 154(b) by 333 days.

(21) Appl. No.: 11/912,209

(22) PCT Filed: Apr. 25, 2006

(86) PCT No.: PCT/US2006/015607

§ 371 (c)(1),
(2), (4) Date: Oct. 22, 2007

(87) PCT Pub. No.: WO2006/137971

PCT Pub. Date: Dec. 28, 2006

(65) Prior Publication Data

US 2008/0151270 A1 Jun. 26, 2008

Related U.S. Application Data

(60) Provisional application No. 60/674,589, filed on Apr. 25, 2005, provisional application No. 60/674,588, filed on Apr. 25, 2005, provisional application No. 60/674,591, filed on Apr. 25, 2005, provisional application No. 60/674,592, filed on Apr. 25, 2005, provisional application No. 60/674,590, filed on Apr. 25, 2005, provisional application No. 60/674,585, filed on Apr. 25, 2005, provisional application No. 60/674,584, filed on Apr. 25, 2005.

(51) Int. Cl.
*B41J 29/393* (2006.01)

(52) U.S. Cl. ..... 347/19; 347/5; 347/9

(58) Field of Classification Search ..... 347/19, 347/78, 5, 9, 14, 15; 346/140.1; 118/300; 348/64

See application file for complete search history.

(56) References Cited

U.S. PATENT DOCUMENTS

| | | | | |
|---|---|---|---|---|
| 5,546,121 | A * | 8/1996 | Gotanda et al. | 348/64 |
| 6,851,784 | B1 * | 2/2005 | Kietzmann | 347/19 |
| 7,104,634 | B2 | 9/2006 | Weksler et al. | |
| 2004/0250760 | A1 * | 12/2004 | Goto | 118/300 |

OTHER PUBLICATIONS

Written Opinion of the International Searching Authority with International Search Report dated May 21, 2008.

* cited by examiner

*Primary Examiner* — Lam S Nguyen
(74) *Attorney, Agent, or Firm* — Harness, Dickey & Pierce, PLC

(57) ABSTRACT

A drop analysis/drop check system allows a plurality of printheads to remain stationary during analysis to emulate operation of an actual piezoelectric microdeposition system. The system provides accurate tuning of individual nozzle ejectors and allows for substrate loading and alignment in parallel with drop analysis/drop check. The drop analysis/drop check system includes a motion controller directing movement of a stage, a printhead controller controlling a printhead to selectively eject drops of fluid material to be deposited on a substrate, and a camera supported by the stage for movement relative to the printheads. The camera receives a signal from the motion controller to initiate exposure of the camera and captures an image of the drops of fluid material ejected by the printheads. A light-emitting device includes a strobe controller that receives a signal from the camera to supply light to an area including the liquid drops during camera exposure.

12 Claims, 5 Drawing Sheets

DROP ANALYSIS SYSTEM

CROSS-REFERENCE TO RELATED APPLICATIONS

This application is a National Stage of International Application No. PCT/US2006/015607, filed Apr. 25, 2006, and claims the benefit of U.S. Provisional Application Nos. 60/674,584, 60/674,585, 60/674,588, 60/674,589, 60/674,590, 60/674,591, and 60/674,592, all filed on Apr. 25, 2005. The disclosures of the above applications are incorporated herein by reference.

FIELD

The present disclosure relates to drop analysis systems and more particularly to an improved drop analysis system for use with a piezoelectric microdeposition apparatus.

BACKGROUND

The statements in this section merely provide background information related to the present disclosure and may not constitute prior art.

Electric printing systems typically include a series of printheads that selectively deposit fluid material onto a workpiece such as a substrate. The printheads and/or substrate may be moved relative to one another to form a pattern of fluid material on a surface of the substrate having a predetermined configuration. One such system is a piezoelectric microdeposition system (PMD) that deposits fluid material on a surface of a substrate by selectively applying electric current to a piezoelectric element associated with a printhead of the PMD system.

Conventional PMD systems may include a drop analysis system associated with respective printheads of the PMD system to ensure that the liquid material deposited from each printhead includes a predetermined shape and/or volume. Controlling the shape and volume of the fluid material deposited by each printhead controls the pattern of fluid material formed on the surface of the substrate.

Conventional drop analysis systems include large diameter lenses and illuminators that are typically located about 30 to 120 millimeters from the drop location of the fluid material to provide sufficient clearance between the printheads of the PMD system and associated mounting hardware of the drop analysis system. Therefore, conventional drop analysis systems are cumbersome and difficult to arrange properly relative to the PMD system.

Typically, drop analysis systems use a light emitting device (LED) and a diffuser screen that cooperate to illuminate drops as they are ejected from the printheads of the PMD system. Interaction between light from the LED and the drop from the printhead illuminates a profile of the drop, which may be captured by a camera. Conventional systems typically require a long-light pulse (i.e., 2 to 5 USEC) from the LED to achieve sufficient illumination of the drop in order for the camera to capture a high-contrast image. Because the drops are released from each printhead at a high speed of ejection (up to 8 meters per second), the long-light pulse of the LED may result in a "blur" of the drop. For example, a 2 USEC pulse may cause an image of the drop captured by the camera to blur by 16 microns (almost 50 percent of the size of the drop itself). Such blurring results in greater uncertainty in the true area and diameter of the drop and results in single drop readings that vary by as much as five percent. Conventional systems can achieve one percent accuracy in measuring drop volume, but can only achieve such accurate readings by taking many image samples, thereby increasing the complexity and cost of the drop analysis system.

SUMMARY

A drop analysis/drop check system allows a plurality of printheads to remain stationary during analysis to emulate operation of an actual piezoelectric microdeposition system. The system provides accurate tuning of individual nozzle ejectors and allows for substrate loading and alignment in parallel with drop analysis/drop check. The drop analysis/drop check system includes a motion controller directing movement of a stage, a printhead controller controlling a printhead to selectively eject drops of fluid material to be deposited on a substrate, and a camera supported by the stage for movement relative to the printheads. The camera receives a signal from the motion controller to initiate exposure of the camera and captures an image of the drops of fluid material ejected by the printheads. A light-emitting device includes a strobe controller that receives a signal from the camera to supply light to an area including the liquid drops during camera exposure.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
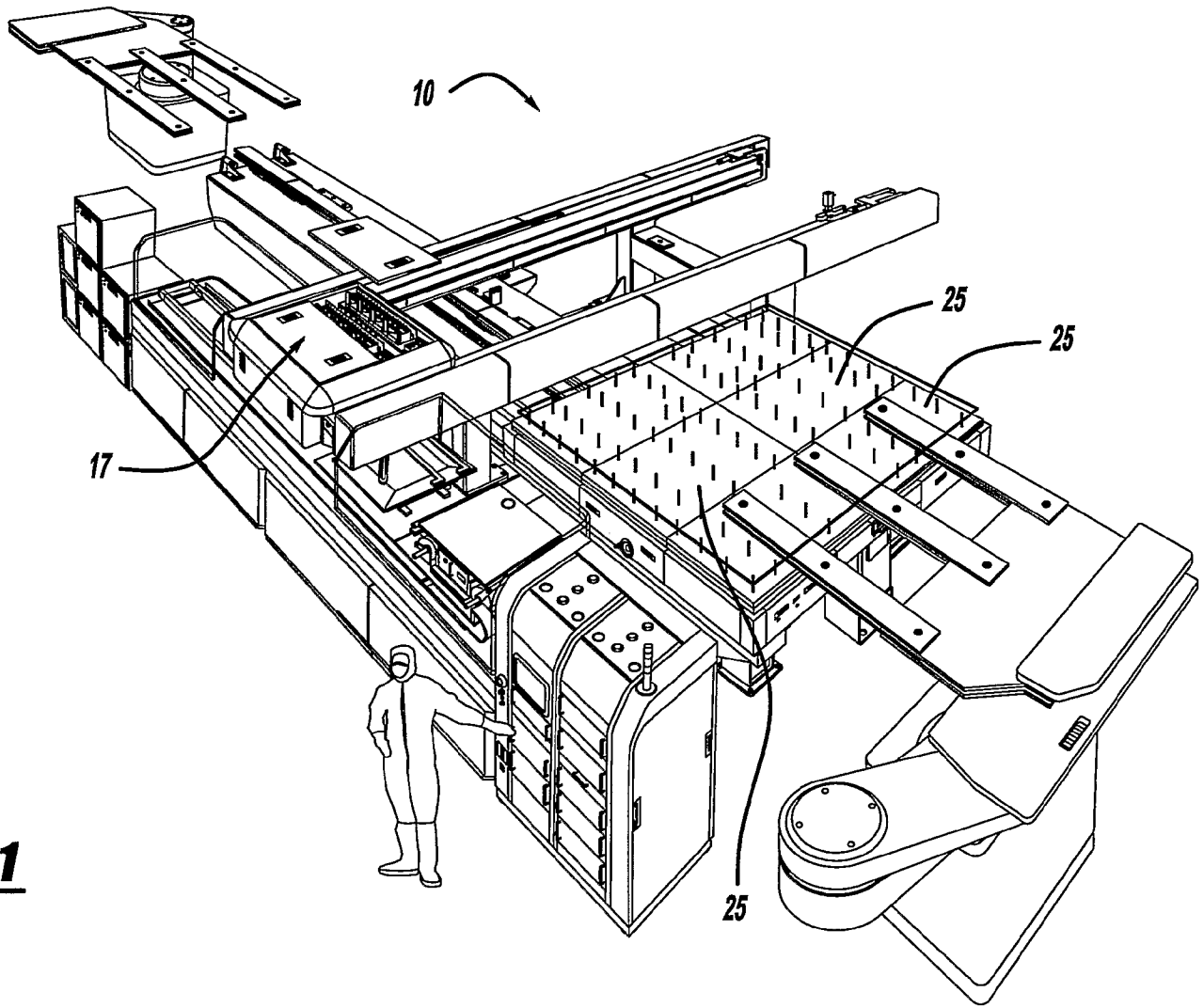
FIG. 1 is a perspective view of a PMD system including a drop analysis system of the present teachings.
Figure 2:
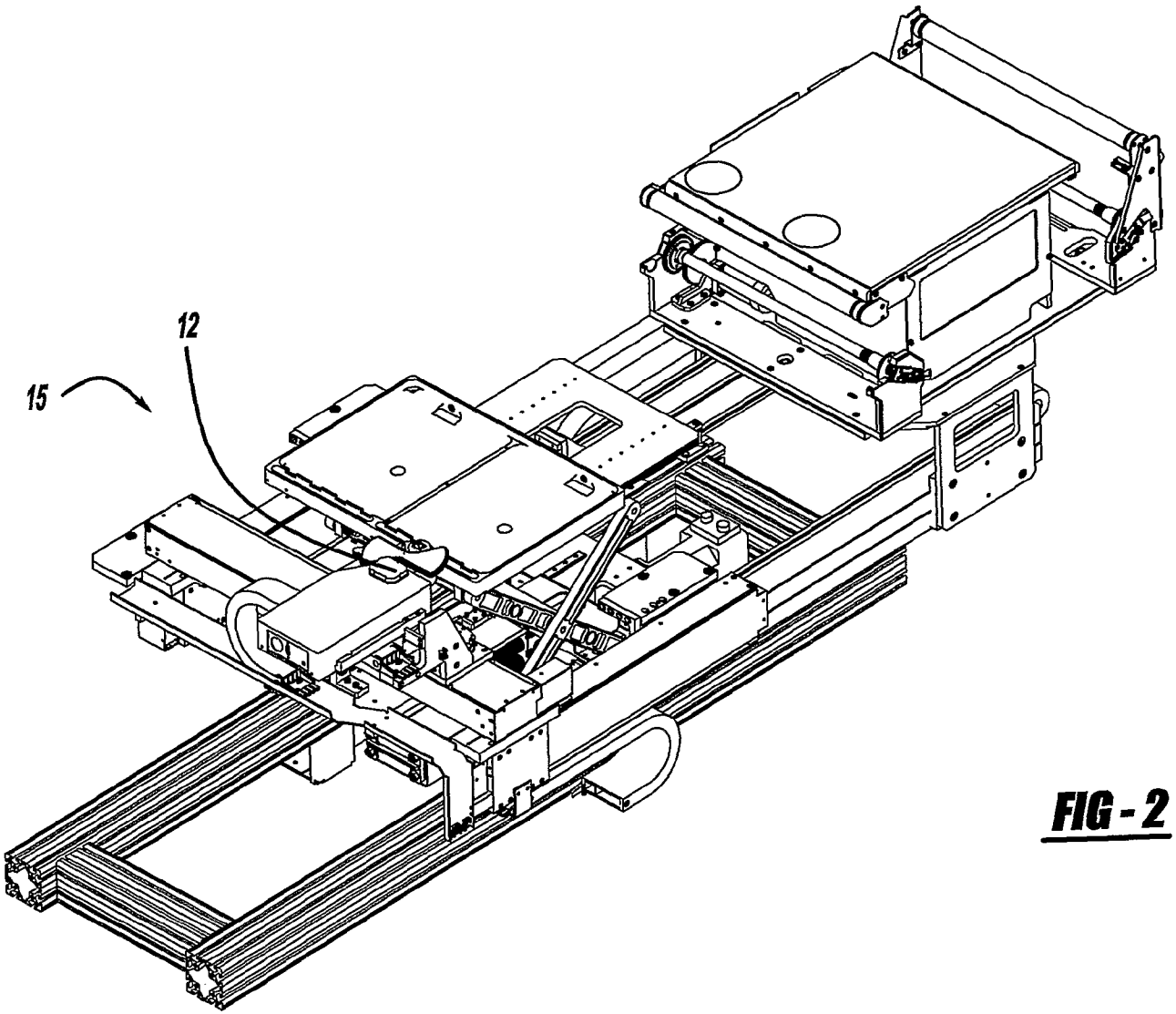
FIG. 2 is a perspective view of a drop analysis stage and optics module in relation to a printhead maintenance station.

The following description is merely exemplary in nature and is not intended to limit the present disclosure, application, or uses. It should be understood that throughout the drawings, corresponding reference numerals indicate like or corresponding parts and features.

With reference to the drawings, a piezoelectric microdeposition (PMD) system 10 is provided and includes a drop imaging system 12 capable of performing a drop check analysis and a drop analysis. The drop imaging system 12 includes a drop view imaging module 14 that is supported by an X/Y/Z stage 15 relative to a series of printheads 17 of the PMD system 10 to capture an image of fluid material ejected from at least one printhead 17.

As will be described herein, the PMD system 10 deposits fluid material onto workpieces such as substrates 25 according to user-defined computer-executable instructions. The term "computer-executable instructions," which is also referred to herein as "program modules" or "modules," generally includes routines, programs, objects, components, data structures, or the like that implement particular abstract data types or perform particular tasks such as, but not limited to, executing computer numerical controls for implementing PMD processes. Program modules may be stored on any computer-readable material such as RAM, ROM, EEPROM, CD-ROM, or other optical disk storage, magnetic disk storage, or other magnetic storage devices, or any other medium capable of storing instructions or data structures and capable of being accessed by a general purpose or special purpose computer.

The terms "fluid manufacturing material" and "fluid material" as defined herein, are broadly construed to include any material that can assume a low viscosity form and is suitable for being deposited from a printhead 17 of the PMD system 10 onto a substrate 25 for forming a microstructure, for example. Fluid manufacturing materials may include, but are not limited to, light-emitting polymers (LEPs), which can be used to form polymer light-emitting diode display devices (PLEDs, and PolyLEDs). Fluid manufacturing materials may also include plastics, metals, waxes, solders, solder pastes, biomedical products, acids, photoresists, solvents, adhesives, and epoxies. The term "fluid manufacturing material" is interchangeably referred to herein as "fluid material."

The term "deposition," as defined herein, generally refers to the process of depositing individual droplets of fluid materials on substrates. The terms 'let," "discharge," "pattern," and "deposit" are used interchangeably herein with specific reference to the deposition of the fluid material from a printhead 17 of the PMD system 10, for example. The terms "droplet" and "drop" are also used interchangeably.

The term "substrate," as defined herein, is broadly construed to include any workpiece or material having a surface that is suitable for receiving a fluid material during a manufacturing process such as a piezoelectric microdeposition process. Substrates include, but are not limited to, glass plates, pipettes, silicon wafers, ceramic tiles, rigid and flexible plastic and metal sheets, and rolls. In certain embodiments, a deposited fluid material may form a substrate having a surface suitable for receiving a fluid material during a manufacturing process, such as, for example, when forming three-dimensional microstructures.

The term "microstructures," as defined herein, generally refers to structures formed with a high degree of precision that are sized to fit on a substrate 25. Because the sizes of different substrates may vary, the term "microstructures" should not be construed to be limited to any particular size and can be used interchangeably with the term "structure". Microstructures may include a single droplet of a fluid material, any combination of droplets, or any structure formed by depositing the droplet(s) on a substrate 25, such as a two-dimensional layer, a three-dimensional architecture, and any other desired structure.

Figure 3:
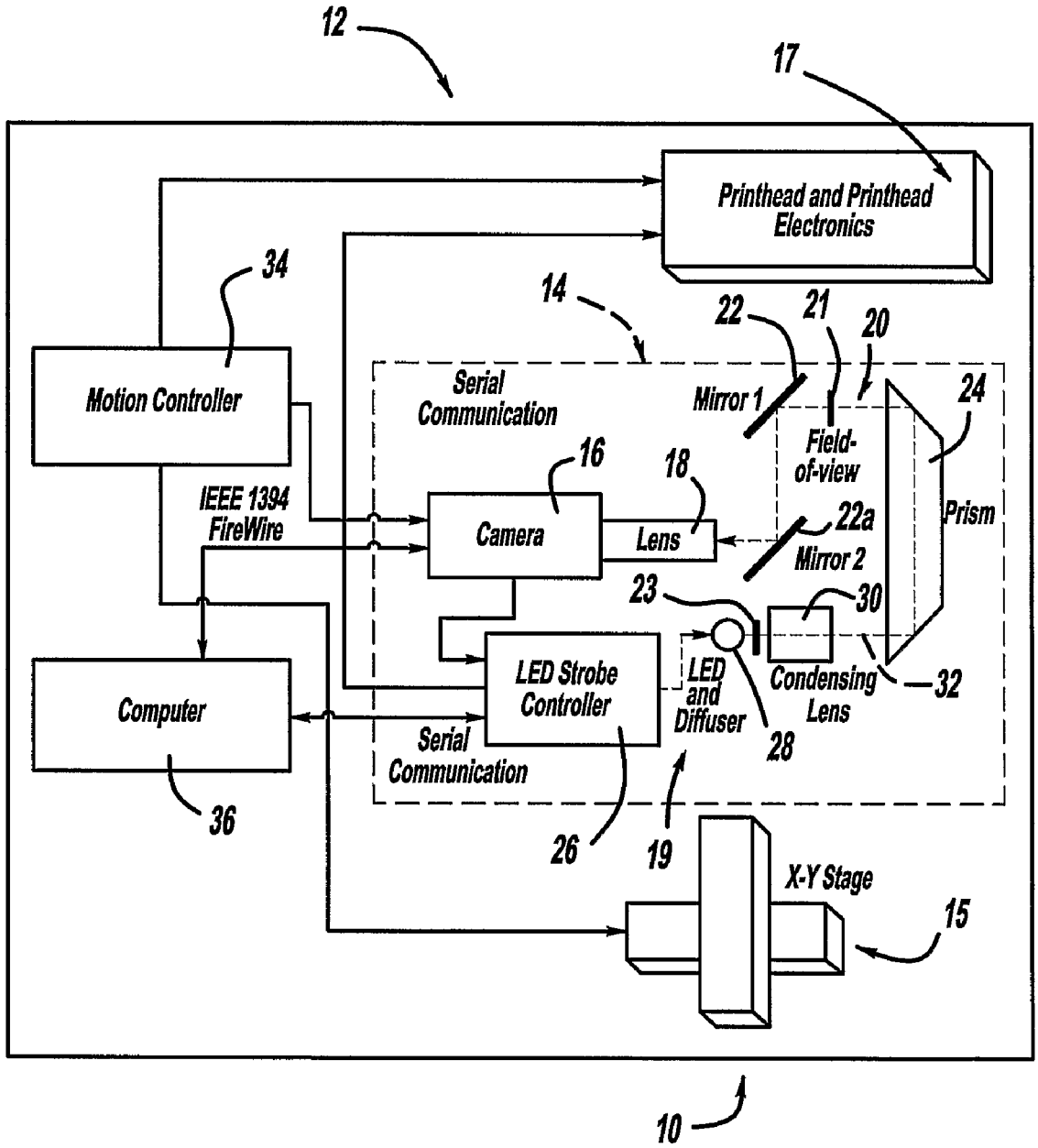
FIG. 3 is a schematic drawing of the drop analysis system of FIG. 1 incorporated into the PMD system of FIG. 1.
Figure 4:
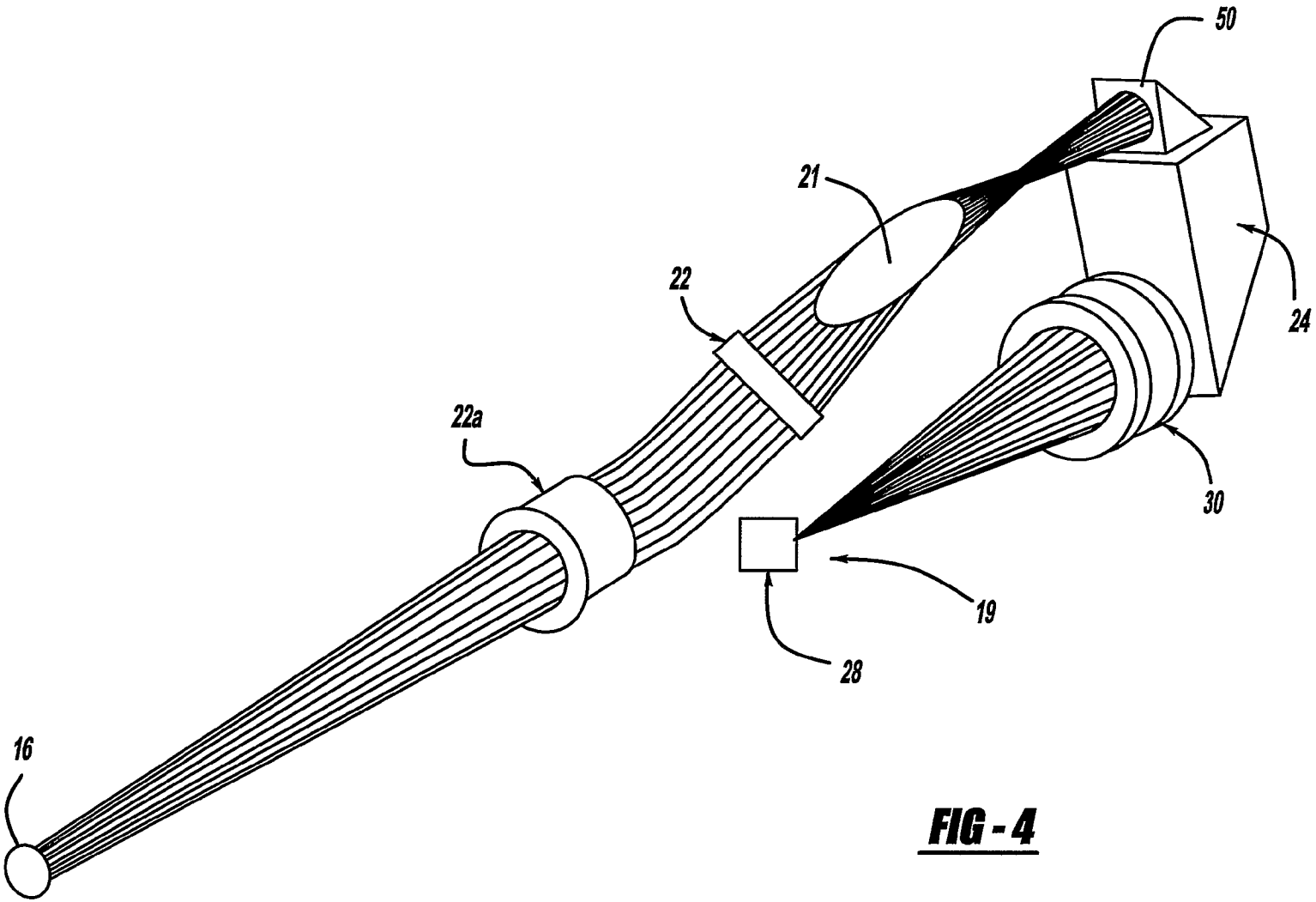
FIG. 4 is a perspective view of a folded optical path used by the drop analysis system of FIG. 1 to illuminate drops ejected by the PMD system during image capture.
Figure 5:
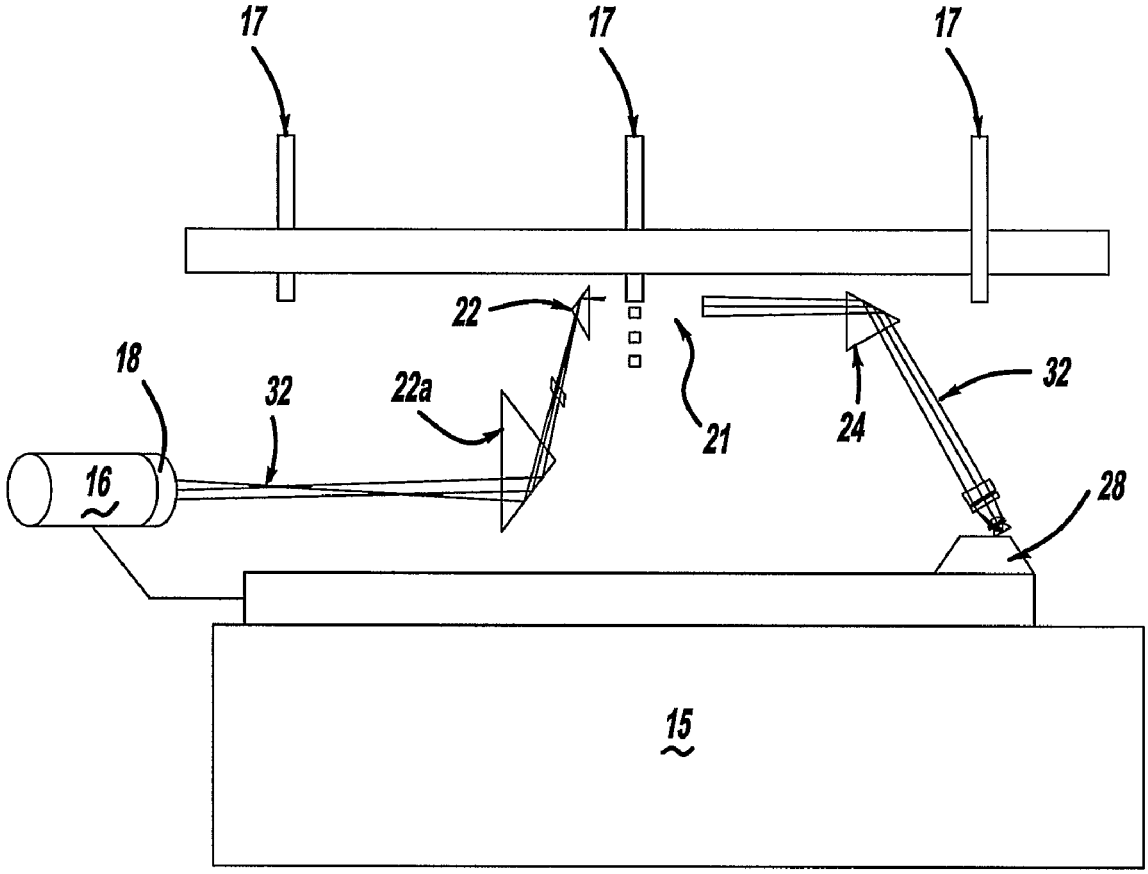
FIG. 5 is a schematic representation of the drop analysis system in relation to a head array and drops of fluid material ejected therefrom of the PMD system of FIG. 1.

With reference to FIG. 3, the drop view imaging module 14 includes a camera 16, an imaging lens 18, mirrors 22, 22*a*, and a prism 24. The drop view imaging module 14 further includes an illumination system 19 having a light emitting device (LED) 28, an LED strobe controller 26, and at least one condensing lens 30.

The mirrors 22, 22*a*, and prism 24 cooperate to fold an optical path 32 (represented by dot and dash lines in a form similar to that of a periscope) generally between the LED 28 and the lens 18. The mirrors 22, 22*a*, and prism 24 fold the optical path 32 such that light from the LED 28 passes through a field-of-view 21 prior to the light being received by the lens 18 and camera 16. Specifically, the prism 24 functions as a "periscope" with the mirrors 22, 22*a* cooperating to further direct the optical path 32 into the lens 18 and camera 16. The prism 24 may include a reduced top portion 50 to facilitate packaging of the prism 24 on the X/Y/Z stage 15.

The field-of-view 21 is positioned relative to a printhead 17 of the PMD system 10 such that liquid material ejected from the printhead 17 of the PMD system 10 passes through the field-of-view 21 and, thus, is illuminated by the LED 28. The field-of-view 21 approximately between 0.6 millimeters and 1.5 millimeters in a first direction and is approximately between 0.6 millimeters and 1.5 millimeters in a second direction. For example, the field-of-view 21 may extend in an X direction approximately 0.9 millimeters and in a Y direction approximately 1.1 millimeters. The X direction may be generally perpendicular to the Y direction.

While a pair of mirrors 22, 22*a*, and a single prism 24 are disclosed, at least one of the mirrors 22, 22*a* can be replaced with a prism while the prism 24 can be replaced with a mirror provided the optical path 32 is properly bent and light from the LED 28 passes through the field-of-view 21 prior to the light reaching the lens 18 and camera 16. The specific configuration of the mirrors and prisms is not limited to two mirrors and one prism, but may be any combination thereof that suitably directs light from the LED 28 through the field-of-view 21 and finally into the lens 18 and camera 16.

The camera 16 may be a commercially available solid-state camera capable of operating both at a resolution of approximately 640×480 at 60 frames per second and at a reduced resolution of approximately 640×100 at 240 frames per second. An image sensor (not shown) of the camera 16 may incorporate any suitable technology such as CCD, CMOS, or CID. The camera 16 can accept an external trigger signal to initiate image acquisition either directly or through a compatible frame grabber. The camera 16, or its frame grabber, is also able to provide a trigger signal to the LED strobe controller 26 to trigger the LED 28 when the camera 16 is exposing its image sensor, if necessary. One example of a preferred camera is Model No. F033B made by Allied Vision, which includes an IEEE 1394 interface, thus eliminating the need for a frame grabber. The camera 16 further includes a CCD sensor that has higher sensitivity and lower fixed pattern noise than most CMOS image sensors.

The lens 18 may be a conventional lens and is selected based on the field-of-view 21 and the specific configuration of the camera 16. In addition to the field-of-view 21 and the specific camera chosen, the lens 18 should also be chosen based on the numerical aperture (F-number) to balance the needs of resolution and depth-of-field. For example, the lens 18 may be an assembly including an infinity corrected objective lens and an imaging lens, such as Model Nos. B50 and FTM 350 made by Thales-Optem. By using an infinity corrected lens system, the objective lens (i.e., condensing lens 30) and the imaging lens (i.e., lens 18) can be separated by a predetermined distance without significantly increasing aberrations. Separation of the condensing lens 30 from lens 18 is accomplished through cooperation between the mirrors 22, 22*a* and the prism 24 such that light from the LED 28 may be directed through the field-of-view 21 and finally into the lens 18 and camera 16.

By spacing the condensing lens 30 from lens 18, the view imaging module 14 is able to maintain a compact design. Without use of the mirrors 22, 22*a* and prism 24, the LED 28 could not be positioned generally adjacent to the lens 18 (FIG. 3), but rather, would have to be positioned in line with the lens 18 such that light from the LED 28 transmitted through the field-of-view 21 could be received by the lens 18. Placing the LED 28 in line with the lens 18 such that the LED 28 and lens 18 are generally positioned within the same plane as the field-of-view 21, would increase the overall size of the drop view imaging module 14 and, thus, would increase the complexity of mounting the drop imaging system 12 to the PMD system 10.

The size and position of the field-of-view 21 is based on the specific application to which the drop view imaging module 14 is used. For example, the size of the field-of-view 21 may be designed to be at least 0.8 millimeters horizontally and about 1.1 millimeters vertically. In such a configuration, the camera 16 is oriented such that the camera 16 scans drops of fluid material ejected from the printhead 17 vertically. With such a configuration, the spatial resolution at the field-of-view 21 is approximately 1.74 pml pixel.

The lens numerical aperture (i.e., F-stop) is selected to yield an optical resolution compatible with the spatial resolution and a depth-of-field compatible with the needs of the application. The depth-of-field is dictated by the possible deviation from the vertical path of a drop of liquid material when ejected by the printhead 17 when the drop of liquid material passes through the field-of-view 21. For example, the depth-of-field may be +/−54 microns having a range of 108 microns. Preferably, the depth-of-field is approximately between 20 microns and 80 microns.

With the above-described field-of-view 21 and depth-of-field ranges, the lens 18 may include a numerical aperture (i.e., F-stop) of 0.11. Configuring the lens 18 to have a numerical aperture of 0.11 yields an illumination wavelength of 455 nm, a diffraction limited optical resolution of 2.51 microns, and a geometrical depth-of-field range of 148 microns. Because there is no numerical aperture that provides both the desired resolution and the desired depth-of-field ranges, choosing the numerical aperture tends to be a trade-off between the optical resolution and the desired depth-of-field range.

The LED 28 of the illumination system 19 is a high-powered light emitting device and may be positioned behind a diffuser 23. The LED 28 may be a Lumiled Luxeon III available from Lumiled Corporation. Preferably, the LED 28 has a dominant wavelength of 455 am as use of a shorter wavelength is preferred to yield a higher diffraction limited resolution. The diffuser 23 may be a replicated diffuser having a 3.8 degree spread angle made from material manufactured by Reflexite, Inc. The diffuser 23 homogenizes the light from the LED 28 with minimal optical loss. The diffuser 23 includes an aperture (not shown) that limits the size of a cone of illumination, which in turn limits the amount by which the field-of-view 21 is overfilled.

Illumination of a drop from a printhead 17 of the PMD system 10 is generally carried out with condenser backlighting. Front lighting is not preferred, as the range of angles required to illuminate the substantially spherical drop becomes problematic. Because the illumination system 19 uses backlighting, Kohler backlighting and critical backlighting are acceptable forms for use with the drop view imaging module 14 and PMD system 10. While critical backlighting provides a more simplistic system, Kohler backlighting may be preferred over critical backlighting, as Kohler backlighting provides greater illumination uniformity and better optical efficiency.

The condensing lens 30 may include a pair of Fresnel lenses having a traditional condenser configuration to image the diffuser 23 onto the field-of-view 21. A supplemental glass lens (not shown) may be used along with the Fresnel lenses to enhance the illumination uniformity. While a supplemental glass lens may be used in addition to the Fresnel lenses, such a configuration may not be required, depending on the configuration of the drop view imaging module 14 and PMD system 10.

The LED strobe controller 26 controls the LED 28 by supplying the LED 28 with a waveform signal. The LED strobe controller 26 receives a trigger signal from the camera 16 and powers the LED 28 with a current waveform (i.e., a signal or pulse) that is adjustable in both amplitude and duration. For example, the LED strobe controller 26 may control the LED 28 using pulse-width modulation by providing a waveform to the LED 28 at a particular amplitude and duration. Adjustment of the amplitude and duration may be either manually set, such as with trimpots or digit switches, or may be remotely programmed such as, for example, via a serial communication port (FIG. 3). Preferably, the LED strobe controller 26 is capable of being both manually set (i.e., via trimpots or digit switches) and remotely programmed (i.e., via a serial communication port).

Exposure of the camera 16 may be controlled based on the amplitude and duration of the waveform supplied to the LED 28. Preferably, the duration of the waveform supplied to the LED 28 is reduced to the lowest duration possible that still yields an acceptable exposure. For example, a waveform duration of one micro-second having an amplitude of approximately 15 Amps may be used. Because drops exiting the printhead 17 are traveling at up to eight meters per second, a drop travels eight meters or 4.6 pixels during a one micro-second waveform. If a shorter pulse is desired, a higher amplitude LED light waveform or a camera with significantly lower noise capability are required.

As described previously, the drop view imaging module 14 is mounted on a motorized X/Y/Z stage 15, which includes motors and encoders (neither shown) to propel the X/Y/Z stage 15 in the X, Y, and Z directions. The motors may be electromagnetic or piezoelectric motors such that a current supplied to the motor causes the drop view imaging module 14 to move in one or both of the X and Y directions after the drop view imaging module 14 has been moved into the desired Z position. The desired Z position represents the desired inspection point or the distance from a nozzle ejector associated with a printhead 17 that represents the effective contact distance when printing over the substrate 25 occurs.

The encoders are preferably optical encoders with a 0.1 micron or finer resolution. While motors and optical encoders are disclosed, any motion system suitable of propelling the stage in the X, Y, and Z directions in a coordinated fashion and any encoder capable of controlling ejection of fluid material from the printheads 17 and image capture by the camera 16 may be used in place of motors and/or optical encoders.

During operation of the drop view imaging module, a drop check procedure may be initiated to verify correct operation of each printhead 17 of the PMD system 10. For a drop check procedure, movement of the X/Y/Z stage transporting the drop view imaging module 14 is essentially continuous such that the printhead 17 and PMD system 10 is monitored throughout operation.

The encoders located on the X/Y/Z stage 15 control ejection of drops of fluid material from each printhead 17 of the PMD system as well as triggering of the camera 16 to acquire an image of the ejected drops via a motion controller 34. The motion controller 34 is preferably a Delta Tau UMAC motion controller.

The motion controller 34 sends a signal to the camera 16 to initiate exposure of the camera 16. Once the camera 16 receives the trigger signal from the motion controller 34, the camera 16 sends a trigger signal to the LED strobe controller 26 to initiate a pulse of light. By allowing the camera 16 to trigger the LED strobe controller 26, a proper amount of light from the LED 28 is emitted and is properly timed with ejection of a drop of fluid material from a respective printhead 17 such that a desired image can be captured by camera 16.

Once the camera 16 has captured an image of the drop of fluid material, the camera 16 transmits data of the image to an image-processing computer 36. The image-processing computer 36 receives the image data from the camera 16 and verifies the correct operation of the printhead 17. Correct operation is determined by comparing the location of the centroid of the drop image to an acceptable window-of-operation that is user defined on the image processing computer 36. Depending on the accuracy of drop ejection required for a particular application, the window-of-operation can be increased to allow for higher reliability of the system. The window-of-operation is stored for each particular print job that may be requested of the PMD system 10 and automatically adjusts without further user interaction.

In addition to performing a drop check procedure, the drop view imaging module 14 may also perform a drop analysis, which measures various metrics of the drops of fluid material ejected by the printhead 17. For example, during a drop analysis procedure, the drops of fluid material ejected by the printhead 17 may be measured for size, area, diameter, volume, velocity of ejection, and directionality of the drop trajectory in the field-of-view 21.

During drop analysis, the drop view imaging module 14 acquires images of a number of drops from a single nozzle of a particular printhead 17. The X/Y/Z stage 15 is able to position the drop view imaging module 14 relative to the monitored printhead 17 through movement in the X, Y, and Z directions. Moving the drop view imaging module 14 in the X and Y directions allows the camera 16 and lens 18 to be properly positioned relative to the field-of-view 21 of a particular printhead 17. Specifically, by moving the drop view imaging module 14 relative to the printhead 17 and associated printhead electronics, the optical path 32 may be positioned such that the optical path 32 crosses the field-of-view 21 to allow the camera 16 to capture an image of a drop of fluid material ejected by a printhead 17.

Movement in the Z direction allows viewing of drops essentially from the point of ejection at the nozzle of a printhead 17 to at least 3 mm from the point of ejection. To obtain accurate area, diameter, and volume measurements it is essential to have stable droplet formation with good circularity of the image. Such accurate measurements are typically accomplished by image capture at distances greater then 1 mm from the nozzle ejector, so the distance must be either set by the operator at the ideal inspection point or set by the image processing computer 36 to automatically select a location based on data consistency and quality.

Motion in the Z direction also allows for characterization of the average drop velocity from the point of ejection at the nozzle to a working surface of the substrate 25. Incorporating this velocity information into the firing data allows for compensation of velocity errors for each nozzle as the deposition process starts on a substrate 25. Such analysis allows the drop view imaging module 14 to detect the drop velocity of the drop of fluid material based on a difference in drop position divided by a change in delay time to an accuracy of approximately 0.1%.

Selection of the optics/camera 16 is a trade off between field-of-view, depth-of-field, frame capture rate, and spatial resolution. The system is based on an optimal spatial resolution of approximately 2.2 microns per pixel on the CCD array to achieve the goals for drop check analysis and drop analysis. Because the system was designed to work with a variety of printheads from different manufacturers with various inherent drop volumes (i.e., from 2 to 80 picoliters), the system can acquire multiple samples per drop as a function of drop size or volume to achieve the 1% measurement accuracy. For example, at 10 pl drop size, 11 samples would be required to average the results and achieve the 1% measurement goal while at 15 pl, only five samples are required. At 30 pl or larger, only one sample is required.

As described above, the optical path 32 is generally bent between the LED 28 and the lens 18 of the camera 16 by the mirrors 22, 22*a*, and prism 24. By bending the optical path 32 between the LED 28 and camera 16, the camera 16, lens 18, and LED 28 may be positioned in relative proximity to one another to reduce the overall size of the drop imaging module 14. Reducing the overall size of the drop imaging module 14 allows greater flexibility in movement of the drop view imaging module 14 relative to the printhead 17 and also allows the drop view imaging module 14 to move in closer proximity to the printhead 17.

During operation of a drop analysis procedure, the LED strobe controller 26 issues a signal to printhead electronics associated with the printhead 17 to trigger the ejection of drops of fluid material from the printhead 17. The frequency of the signal sent by the LED strobe controller 26 is approximately equal to a drop frequency of fluid material during printing. For example, the drop frequency may approximately be 10 kHz.

To ensure that the requisite images of each drop of fluid material are acquired, a strobe controller board (not shown) associated with the LED strobe controller 26 includes a list of required images with associated delay times from the drop trigger signal. For example, if an image of a drop of fluid material is required shortly after ejection from the printhead 17, the delay from triggering of the drop to triggering of image acquisition and illumination from LED 28 would be relatively small to ensure that the image of the drop is acquired shortly after ejection from the printhead 17. Conversely, if the required image is such that the overall shape of the drop just prior to reaching the substrate 25 is desired, the delay between the trigger signal that ejects the drop of fluid material from the printhead 17 and the trigger signal that initiates image acquisition and illumination would be somewhat larger to allow the drop to be fully released by the printhead 17 prior to the camera 16 acquiring an image.

Prior to the strobe controller issuing a trigger signal to the printhead 17 to eject a drop of fluid material, a signal from the camera 16 must first be received by the LED strobe controller 26, alerting the LED strobe controller 26 that the camera 16 is not busy and is ready to acquire an image. When the camera 16 is not busy acquiring an image or transmitting an image to the image-processing computer 36, the LED strobe controller 26 is able to trigger the camera 16 to acquire an image of a drop of fluid material ejected by the printhead 17 and is able to synchronize an ejection of fluid material from the printhead 17 with exposure of the camera 16.

As noted above, the LED strobe controller 26 directs ejection of a drop of fluid material from the printhead 17 once the camera 16 indicates that it is not busy, and will direct the camera 16 to capture an image of the drop of fluid material a predetermined time following ejection of the fluid drop from the printhead 17. The predetermined amount of time is based on the desired image (i.e., shortly following ejection or just prior to the drop of fluid material reaching the substrate, for example). The differences in the predetermined delays allows the drop analysis module 14 to capture images of drops of fluid material at various positions following ejection from a printhead 17.

The LED strobe controller 26 continually initializes the acquisition of images of drops of fluid material from the printhead 17 until each of the requisite images stored in the list within the strobe controller board are acquired. Once each of the requisite images are acquired by the LED strobe controller 26, the images are transmitted to the image-processing computer 36 for analysis.

Because drop analysis takes an in depth measure of the overall size, shape, and velocity of the drops of fluid material being ejected by the printhead 17, the drop analysis procedure is typically performed less frequently than the drop checking procedure. However, the drop analysis procedure may be performed each time a printhead 17 is engaged to ensure that the printhead 17 is providing drops of fluid material that meet a predetermined size, shape, and velocity. The interval to perform drop analysis can be selected by the operator as a function of time or number of substrates 25 that have been printed since last analysis.

The invention claimed is:

1. An analysis system comprising:

a stage;

a motion controller that directs movement of the stage;

a printhead;

a printhead controller that is in communication with the motion controller, that controls the printhead to selectively eject drops of fluid material to be deposited on a substrate, and that controls the printhead to selectively eject drops of fluid material for drop analysis;

a camera supported by the stage for movement relative to the printhead, the camera selectively receiving a first trigger signal from the motion controller to initiate exposure of the camera and capturing of an image of the drops of fluid material ejected by the printhead;

a light-emitting device having a strobe controller, the strobe controller selectively receiving a second trigger signal from the camera to supply a pulse of light from the light-emitting device to an area including the drops during the exposure;

a prism supported by the stage for movement relative to the printhead, wherein the pulse of light from the light-emitting device is folded by the prism to pass through the area and arrive at the camera;

a diffuser located proximate to the light-emitting device;

a condensing lens located between the diffuser and the prism;

an imaging lens located proximate to the camera;

a first mirror located between the prism and the imaging lens; and a second mirror located between the first mirror and the imaging lens, wherein the motion controller positions the stage such that the area is located between the first mirror and the prism.

2. The analysis system of claim 1 further comprising a computer in communication with the camera, wherein the computer is located remotely from the camera.

3. The analysis system of claim 1 further comprising a computer in communication with the camera, wherein the camera transmits image data to the computer following the exposure, and wherein the computer includes a processor and memory storing predetermined operating parameters of the printhead for comparison to data received from the camera.

4. The analysis system of claim 1 wherein the printhead controller selectively receives instructions from the motion controller to deposit the drops of fluid material on the substrate, and wherein the strobe controller is in communication with the printhead controller and the camera.

5. The analysis system of claim 1 wherein the printhead is stationary during the exposure of the camera and illumination of the light-emitting device.

6. The analysis system of claim 1 further comprising a substrate stage that supports the substrate and that moves the substrate in a direction perpendicular to a direction of travel of the printhead.

7. The analysis system of claim 1 wherein the camera captures a predetermined number of images of the drops of fluid material and the predetermined number of images is based on a volume of the drops of fluid material.

8. The analysis system of claim 1 wherein the drops of fluid material are ejected generally in a Z direction, and wherein the stage moves the camera along a Z axis parallel to the Z direction.

9. The analysis system of claim 8 wherein the stage positions the camera along the Z axis to capture the image of the drops of fluid material at a distance from a nozzle of the printhead that represents an effective contact distance during printing on the substrate.

10. The analysis system of claim 1 wherein the prism includes a reduced top portion.

11. The analysis system of claim 6 wherein the substrate stage is configured to receive the substrate in parallel with exposure of the camera and illumination of the light-emitting device.

12. The analysis system of claim 6 wherein the stage is configured to move along X, Y, and Z axes, wherein the X, Y, and Z axes are perpendicular to each other.

* * * * *